US006958316B2

(12) United States Patent
Kubo et al.

(10) Patent No.: US 6,958,316 B2
(45) Date of Patent: Oct. 25, 2005

(54) THICKENER

(75) Inventors: Makoto Kubo, Wakayama (JP); Kazuhiro Iitaka, Wakayama (JP); Takaya Sakai, Wakayama (JP); Yoshifumi Nishimoto, Wakayama (JP); Yohei Kaneko, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 10/493,307

(22) PCT Filed: Oct. 22, 2002

(86) PCT No.: PCT/JP02/10954

§ 371 (c)(1),
(2), (4) Date: Aug. 25, 2004

(87) PCT Pub. No.: WO03/040253

PCT Pub. Date: May 15, 2003

(65) Prior Publication Data

US 2004/0266657 A1 Dec. 30, 2004

(30) Foreign Application Priority Data

Nov. 8, 2001 (JP) ..... 2001-342837
Sep. 4, 2002 (JP) ..... 2002-259181

(51) Int. Cl.[7] ..... C11D 1/66; C11D 3/32

(52) U.S. Cl. ..... 510/501; 510/126; 510/130; 510/158; 510/159; 564/215

(58) Field of Search ..... 510/126, 130, 510/158, 159, 501; 564/215

(56) References Cited

U.S. PATENT DOCUMENTS 6,514,918 B1 * 2/2003 Librizzi ..... 510/124

FOREIGN PATENT DOCUMENTS

| | | | |
|---|---|---|---|
| JP | 10-245598 | | 9/1998 |
| JP | 11-246500 | | 9/1999 |
| JP | 2000-169887 | | 6/2000 |
| WO | WO99/46356 | * | 9/1999 |

* cited by examiner

*Primary Examiner*—Gregory R. Del Cotto
(74) *Attorney, Agent, or Firm*—Oblon, Spivak, McClelland, Maier & Neustadt, P.C.

(57) ABSTRACT

The present invention provides a thickener which is superior in compounding stability and has high thickening action and a surfactant composition containing the thickener. The present invention relates to a thickener comprising a fatty acid amide ether compound (1) and to a surfactant composition comprising this thickener and at least one surfactant. Namely, the present invention relates to a method of increasing the viscosity of a surfactant by using this thickener.

(1)

wherein $R^1$ represents a straight-chain or branched alkyl or alkenyl group which has 5 to 21 carbon atoms and may be substituted with at least one hydroxyl group, $R^2$ represents a straight-chain or branched alkyl group having 1 to 12 carbon atoms and $R^3$ represents an alkylene group having 2 to 12 carbon atoms.

14 Claims, 2 Drawing Sheets

THICKENER

FIELD OF THE INVENTION

The present invention relates to a thickener having a high thickening effect and a surfactant composition including the thickener.

BACKGROUND OF THE INVENTION

Detergent compositions are improved in handling characteristics by allowing them to have a proper viscosity corresponding to each use or made to have a system increased appropriately in viscosity to keep the dispersibility of water-insoluble substances compounded therein.

Generally, alkanolamide type surfactants, betaine type surfactants and semi-polar type surfactants (e.g., alkyldimethylamine oxides) are known as thickeners and used in many surfactant applications at present.

The alkanolamide type surfactants are classified into a monoalkanolamide type and a dialkanolamide type. Although the monoalkanolamide type has a high thickening effect, it cannot be said to be a compound having high handling characteristics because it has a high melting point.

On the other hand, the dialkanolamide type has excellent compounding stability. However, this type is inferior in thickening effect to the monoalkanolamide type and it is therefore difficult to obtain a desired viscosity in a reasonable amount.

In this situation, a thickener which has high compounding stability, a high thickening effect, is superior in foaming characteristics and is preferably used for detergent compositions and the like has been desired.

In the meantime, JP-A No. 11-246500 discloses a method of producing an amide compound represented by the formula (I') and that this amide compound has high performance as a surfactant.

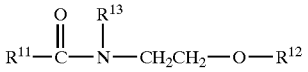

(I')

In the formula, $R^{11}$ represents a straight-chain or branched alkyl or alkenyl group having 7 to 21 carbon atoms, $R^{12}$ represents a straight-chain or branched alkyl or alkenyl group having 1 to 4 carbon atoms and $R^{13}$ represents a hydrogen atom, a straight-chain or branched alkyl or alkenyl group having 1 to 21 carbon atoms, a straight-chain or branched alkyl or alkenyl group having 1 to 21 carbon atoms, containing two or less hydroxy groups or alkoxyl groups and excluding groups represented by —$CH_2CH(OH)CH_2OR^{12}$ or a group represented by -$(A'O)_n$—H (where A' represents an ethylene group or a propylene group and n denotes a number of 1 to 10).

However, this reference only discloses that the amide compound is useful as a foam-increasing agent. Also, the amide compounds disclosed specifically in the examples described in this reference are all tertiary amide compounds and therefore essentially differ from the fatty acid amide ether compound according to the present invention.

SUMMARY OF THE INVENTION

The present invention is to provide a thickener having a high thickening effect and also to provide a surfactant composition containing the thickener.

The inventors of the present invention have made earnest studies and, as a result, found that the addition of a specified fatty acid amide ether compound to various surfactants brings about a high thickening effect and excellent foaming characteristics.

Accordingly, the present invention provides a thickener containing a fatty acid amide ether compound (hereinafter referred to as "compound 1") and also provides a surfactant composition containing the thickener and at least one surfactant:

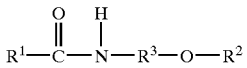

(1)

wherein $R^1$ represents a straight-chain or branched alkyl or alkenyl group which has 5 to 21 carbon atoms and may be substituted with at least one hydroxyl group, $R^2$ represents a straight-chain or branched alkyl group having 1 to 12 carbon atoms and $R^3$ represents an alkylene group having 2 to 12 carbon atoms.

Particularly, the present invention provides a thickener containing a fatty acid amide ether compound represented by the formula (1—1) or (1–2):

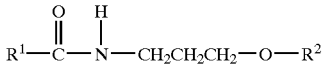

(1-1)

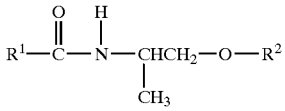

(1-2)

wherein $R^1$ and $R^2$ have the same meanings as above, respectively.

Also, the present invention provides a method of thickening a surfactant by mixing the above fatty acid amide ether compound with the surfactant and a use of the above fatty acid amide ether compound as a thickener.

DETAILED DESCRIPTION OF THE INVENTION

In the compound (1) used in the present invention, $R^1$ represents a straight-chain or branched alkyl or alkenyl group which has 5 to 21 carbon atoms and may be substituted with at least one hydroxyl group and is preferably a group having 7 to 17 carbon atoms. Specific examples of the alkyl or alkenyl group include residues obtained by removing a carboxyl group from fatty acids such as caprylic acid, capric acid, lauric acid, myristic acid, palmitic acid, stearic acid, oleic acid, ricinoleic acid, 12-hydroxystearic acid and isostearic acid.

$R^2$ represents an alkyl group having 1 to 12 carbon atoms. Specific examples of the alkyl group include a methyl group, ethyl group, propyl group, isopropyl group, butyl group, hexyl group, 2-ethylhexyl group, octyl group, dodecyl group and the like and preferable examples are alkyl groups having 1 to 8 carbon atoms.

$R^3$ represents an alkylene group having 2 to 12 carbon atoms. Specific examples of the alkylene group include an ethylene group, propylene group, isopropylene group, butylene group, hexylene group, 2-ethylhexylene group, octylene group, dodecylene group and the like. The alkylene group is preferably alkylene groups having 2 to 8 carbon atoms, more preferably alkylene groups having 2 or 3 carbon atoms and even more preferably alkylene groups having 3 carbon atoms.

Among the compounds (1), fatty acid amide ether compounds represented by the above formula (1—1) and the above formula (1–2) are particularly superior as the thickener.

The compound (1) of the present invention may be produced by reacting a higher fatty acid represented by the formula (2):

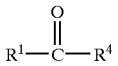

(2)

[wherein $R^1$ has the same meaning as above and $R^4$ represents an alkoxy group having 1 to 3 carbon atoms, a group represented by the formula: —$CH_2CH(OY)$ —$CH_2(OZ)$ (where Y and Z represent, independently of each other, a hydrogen atom, a straight-chain or branched acyl group which has 6 to 22 carbon atoms and may be substituted with at least one hydroxyl group) or a halogen atom], or its derivative (hereinafter referred to as "fatty acid component (2)") with an alkoxyamine (hereinafter referred to as "amine (3)" represented by the formula (3):

$$H_2N—R^3—O—R^2 \quad (3)$$

wherein $R^2$ and $R^3$ have the same meanings as above, respectively.

Examples of the fatty acid component (2) used in the production of the compound (1) include fatty acids such as caprylic acid, capric acid, lauric acid, myristic acid, palmitic acid, stearic acid, oleic acid, ricinoleic acid, 12-hydroxystearic acid and isostearic acid; alkyl esters of these fatty acids, for example, methyl esters and ethyl esters; glycerides of these fatty acids, for example, natural oil and fats such as coconut oil, palm oil and palm kernel oil; and halides (e.g., chlorides and bromides) of these fatty acids. Among these fatty acid components (2), fatty acids, fatty acid alkyl esters and fatty acid glycerides are particularly preferable because they are unaccompanied by the production of inorganic salts.

Examples of the amine (3) include 3-methoxypropylamine, 3-ethoxypropylamine, 3-isopropyloxypropylamine, 3-propyloxypropylamine, 3-(2-ethylhexyloxy)-propylamine, 2-methoxyisopropylamine and the like.

The reaction between the fatty acid component (2) and the amine (3) may be run under a generally known reaction condition and proceeds in the presence of a catalyst using an alcoholate and the like or also in the presence of no catalyst.

For example, as to the temperature of the reaction between a fatty acid alkyl ester, coconut oil or palm kernel oil and the amine (3), the reaction proceeds at a temperature range from 50 to 130° C. in the case of using sodium methylate as a catalyst and at a temperature range from 130 to 220° C. in the case of using no catalyst. Also, when a fatty acid is used as starting material, the reaction proceeds at a reaction temperature of 120 to 220° C.

Also, a fatty acid halide may be reacted with the amine (3) using a known method. As regards, for example, a reaction between fatty acid chloride and the amine (3), the amine (3) is charged in an aqueous solution system in the presence of an organic solvent or in an aqueous solution system and the fatty acid chloride and an alkali are added dropwise to the aqueous solution system simultaneously while controlling the system pH to 7 to 12 to run a reaction at a reaction temperature of −20 to 50° C. Examples of the organic solvent in this case include acetone, isopropyl alcohol, diethyl ether and the like. Examples of the alkali include sodium hydroxide, potassium hydroxide, sodium carbonate, sodium bicarbonate and the like.

The molar ratio ((2):(3)) of the fatty acid component (2) to the amine (3) is in a range preferably from 1:1 to 1:1.3 and more preferably 1:1 to 1:1.1 when the fatty acid component (2) is a compound other than fatty acids. It is preferably in a range from 1:3.0 to 1:3.9 and more preferably 1:3.0 to 1:3.3 when the fatty acid component (2) is a fatty acid from the viewpoint of reactivity and from an economical point of view.

The compound (1) of the present invention obtained after the reaction is finished may contain unreacted products and byproducts to the extent that these products hinder the actual use of the compound 1.

The compound (1) of the present invention can raise the viscosity of the compounding composition in combination with a surfactant and is therefore useful as a thickener for these compositions. Also, the compound (1) has the effect of improving the foaming property.

Examples of the surfactant include anionic surfactants, amphoteric surfactants, cationic surfactants, nonionic surfactants, semi-polar surfactants and the like (e.g., alkyldimethylamine oxides). A significant thickening action is obtained particularly in an anionic surfactant system.

Examples of the anionic surfactant used in the present invention include alkyl sulfates, polyoxyethylene alkyl ether sulfates, alkylbenzene sulfonates, alkyl fatty acid salts, alkyl phosphates, acylated amino acid salts alkylamide ether sulfates and the like. The alkyl groups of these anionic surfactants are preferably those having 5 to 30 carbon atoms and more preferably those having 8 to 18 carbon atoms and the acyl groups of these surfactants are preferably those having 6 to 31 carbon atoms and more preferably those having 7 to 17 carbon atoms. Examples of the salt include alkali metal salts, ammonium salts, alkyl or alkenylamine salts having totally 1 to 22 carbon atoms, alkanolamine salts having totally 1 to 22 carbon atoms and basic amino acid salts. The salt is preferably alkali metal salts and more preferably sodium salts and potassium salts.

In the surfactant composition containing the compound (1) and a surfactant according to the present invention, the content of the compound (1) is preferably 0.1 to 50% by weight and more preferably 0.5 to 20% by weight. Also, the content of the surfactant is preferably 0.5 to 90% by weight and more preferably 1 to 50% by weight.

The compound (1) of the present invention may be formulated in detergents, cosmetics and the like. The proportion of the compound (1) to be formulated in these detergents or cosmetics is preferably 0.1 to 50% by weight and more preferably 0.5 to 20% by weight in these detergents or cosmetics though no particular limitation is imposed on the proportion. Also, a two-component system containing the compound (1) and various surfactants may be used or the compound (1) may be added to a combination of these various surfactants upon use according to the use of the detergent.

EXAMPLES

In Synthetic Examples, the saponification value (SV) and the total amine value were measured in the following methods.

<Saponification Value>

A known amount of 0.5 N KOH (added in an amount excess by 50 to 60% to the sample) was added to a known amount of the sample to titrate the sample by using 0.2 N HCl in an automatic potentiometric titrator (AT-310J, manufactured by Kyoto Denshi (sha)) and then the saponification value (SV) was found according the following equation.

SV=(11.22×0.2 N HCl factorxtiter (cc)*)/Sample (g) *: Titer of 0.2 N HCl required since the first-stage inflection point till the second-stage inflection point.

<Total Amine Value>

A known amount of the sample was poured into an ethanol solution to which a BCG (Bromocresol Green) indicator was added to titrate the sample until the color in the system was changed from green to yellow to find the total amine value according to the following equation.

Total amine value=(11.22×0.2 N HCl factorxtiter (cc))/Sample (g)

Synthetic Example 1 (Synthesis of Coconut Oil Fatty Acid Amidopropyl Methyl Ether)

A 1 L reaction container equipped with a thermometer, a stirrer, a nitrogen blowing tube and a reflux condenser was charged with 217 g (Mw: 657.5, 0.33 mol) of coconut oil and 97 g (Mw: 89.1, 1.09 mol) of 3-methoxypropylamine. The mixture was raised to 95° C. while nitrogen is blown into the container and 5 g of 28% sodium methylate was added to the mixture. Thereafter, the resulting mixture was kept as it was for 3 hours. The termination of the reaction was confirmed by finding, using gas chromatography, that the amount of the residual coconut oil was less than 3%. Excess amine was distilled under a reduced pressure.

Figure 1:
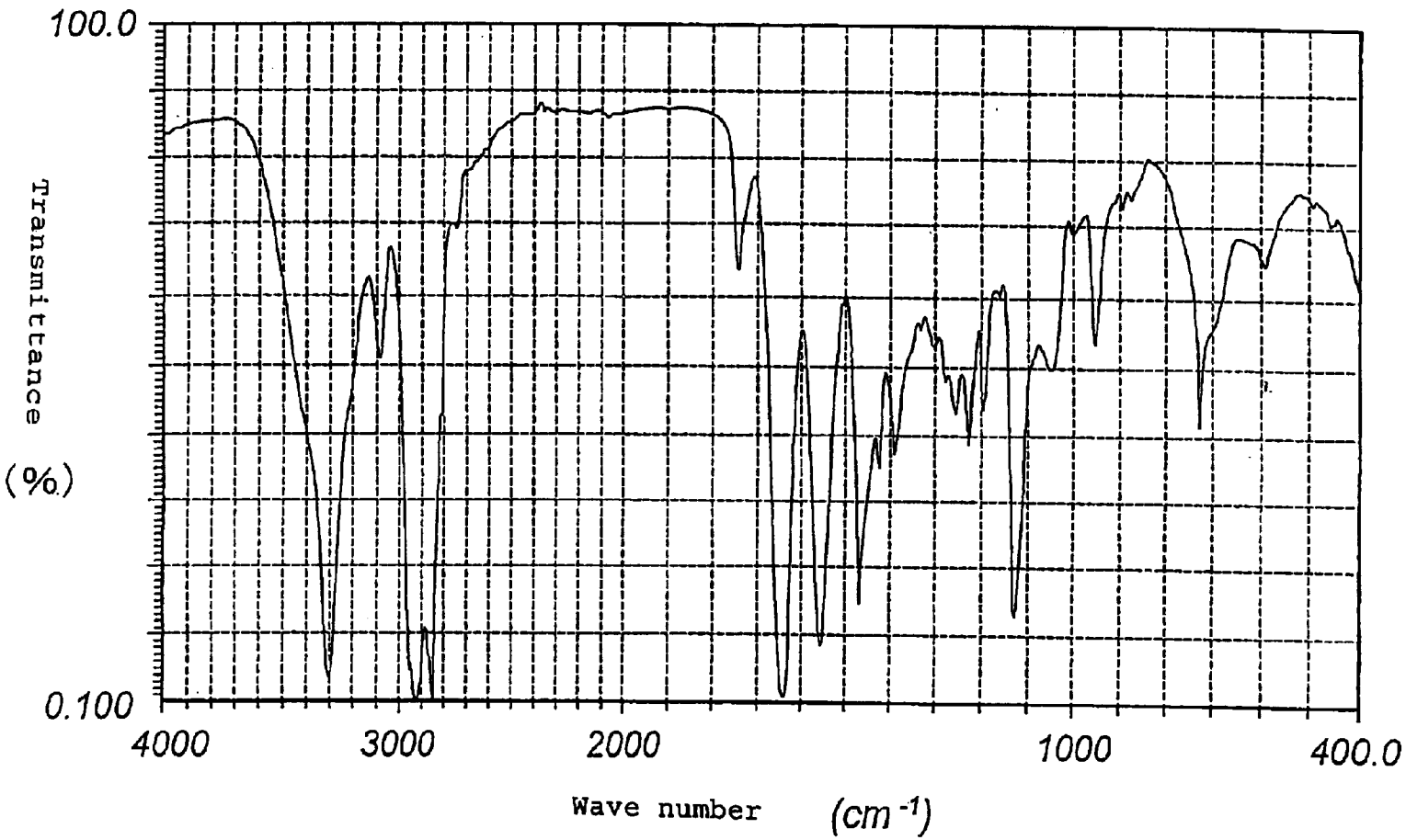
FIG. 1 is an infrared absorption spectrum of a fatty acid amide ether compound obtained in Synthetic Example 1.

The SV (saponification value) and total amine value of the resulting coconut oil fatty acid amidopropyl methyl ether were 5.7 and 6.0, respectively. An infrared absorption spectrum as shown in FIG. 1 was obtained.

Synthetic Example 2 (Synthesis of Lauric Acid Amidopropyl Methyl Ether)

The same reaction container that was used in Synthetic Example 1 was charged with 214 g (Mw: 214, 1 mol) of methyl laurate and 98 g (1.1 mol) of 3-methoxypropylamine. The mixture was raised to 95° C. while nitrogen is blown into the container and 5 g of 28% sodium methylate was added to the mixture while nitrogen is blown into the container. Thereafter, the resulting mixture was kept as it was for 3 hours. The termination of the reaction was confirmed by finding using gas chromatography that residual methyl laurate was less than 3% and excess amine was distilled under reduced pressure.

Synthetic Example 3 (Synthesis of Palm Kernel Fatty Acid Amidopropyl Methyl Ether)

The same reaction container that was used in Synthetic Example 1 was charged with 226.4 g (Mw: 686.0, 0.33 mol) of palm kernel oil and 97 g (1.09 mol) of 3-methoxypropylamine. The mixture was raised to 95° C. while nitrogen is blown into the container and 5 g of 28% sodium methylate was added to the mixture. Thereafter, the resulting mixture was kept as it was for 3 hours. The termination of the reaction was confirmed by finding using gas chromatography that residual palm kernel oil was less than 3% and excess amine was distilled under reduced pressure.

Synthetic Example 4 (Synthesis of Lauric Acid Amide Propyl Ethyl Ether)

The same reaction container that was used in Synthetic Example 1 was charged with 214 g (1 mol) of methyl laurate and 113.5 g (Mw: 103.2, 1.1 mol) of 3-ethoxypropylamine. The mixture was raised to 95° C. while nitrogen is blown into the container and 5 g of 28% sodium methylate was added to the mixture. Thereafter, the resulting mixture was kept as it was for 3 hours. The termination of the reaction was confirmed by finding using gas chromatography that residual methyl laurate was less than 3% and excess amine was distilled under reduced pressure.

Synthetic Example 5 (Synthesis of Lauric Acid Amidopropyl 2-Ethylhexyl Ether)

The same reaction container that was used in Synthetic Example 1 was charged with 214 g (1 mol) of methyl laurate and 206 g (Mw: 187.3, 1.1 mol) of 3-(2-ethylhexyloxy) propylamine. The mixture was raised to 95° C. while nitrogen is blown into the container and 5 g of 28% sodium methylate was added to the mixture. Thereafter, the resulting mixture was kept as it was for 3 hours. The termination of the reaction was confirmed by finding using gas chromatography that residual methyl laurate was less than 3% and excess amine was distilled under reduced pressure.

Synthetic Example 6 (Synthesis of Coconut Fatty Acid Amidopropyl Isopropyl Ether)

The same reaction container that was used in Synthetic Example 1 was charged with 217 g (0.33 mol) of coconut oil and 127.5 g (Mw: 117.1, 1.09 mol) of 3-isopropyloxypropylamine. The mixture was raised to 95° C. while nitrogen is blown into the container and 5 g of 28% sodium methylate was added to the mixture. Thereafter, the resulting mixture was kept as it was for 3 hours. The termination of the reaction was confirmed by finding using gas chromatography that residual coconut oil was less than 3% and excess amine was distilled under reduced pressure.

Synthetic Example 7 (Synthesis of Lauric Acid Amidoisopropyl Methyl Ether)

The same reaction container that was used in Synthetic Example 1 was charged with 200 g (1 mol) of lauric acid and 98 g (Mw: 89.1, 1.1 mol) of 2-methoxyisopropylamine. The mixture was raised to 165° C. over 2 hours while nitrogen is blown into the container. Thereafter, the mixture was aged for 2 hours. Then, 30 g of 2-methoxyisopropylamine was added dropwise over 30 minutes and the resulting mixture was kept as it was for 3 hours. The termination of the reaction was confirmed by finding using gas chromatography that residual lauric acid was less than 3% and excess amine was distilled under reduced pressure.

Figure 2:
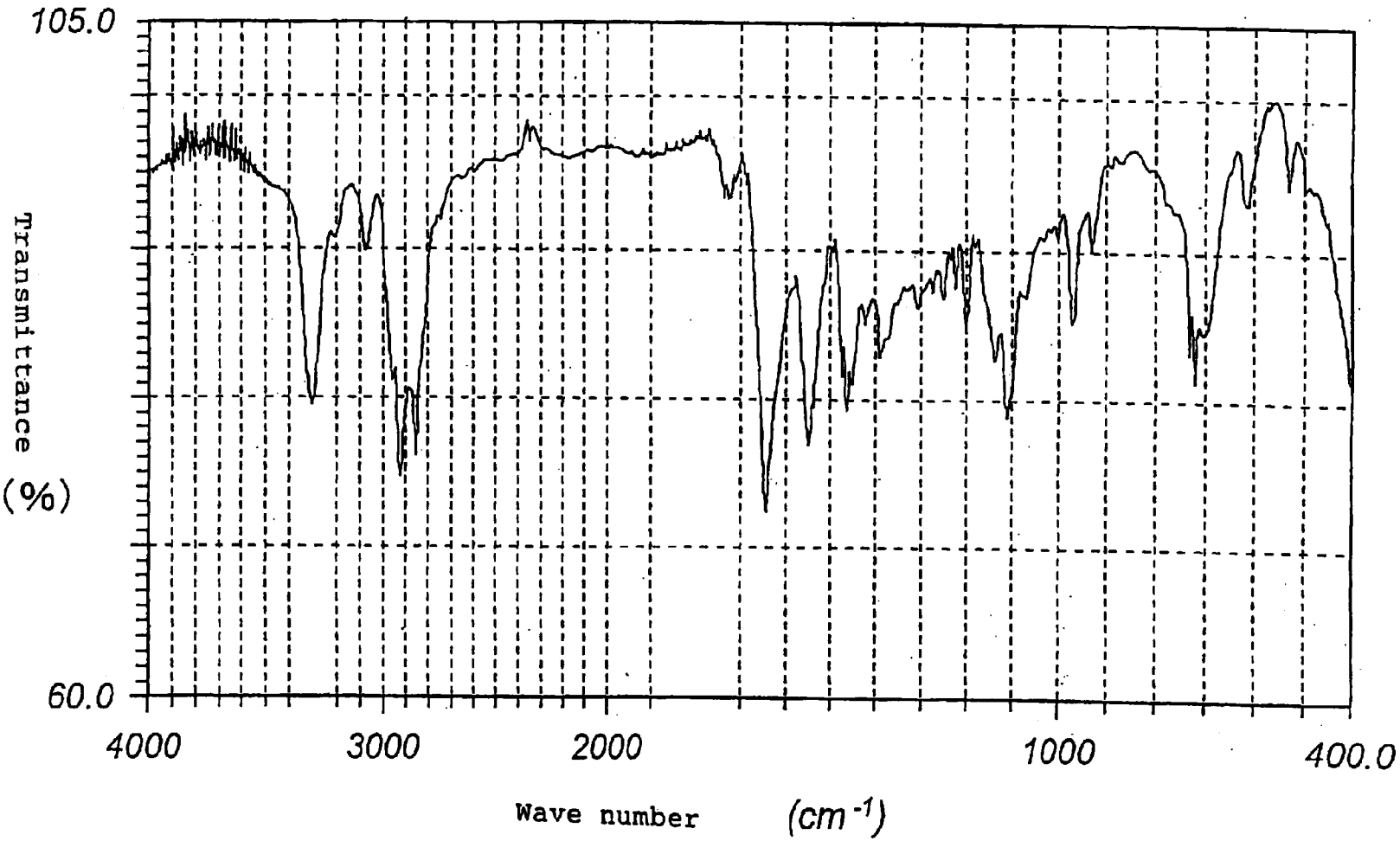
FIG. 2 is an infrared absorption spectrum of a fatty acid amide ether compound obtained in Synthetic Example 7.

The SV (saponification value) and total amine value of the resulting lauric acid amidoisopropyl methyl ether were 8.0 and 4.0, respectively, and also an infrared absorption spectrum as shown in FIG. 2 was obtained.

Synthetic Example 8 (Synthesis of Palm Kernel Fatty Acid Amidopropyl Isopropyl Ether)

The same reaction container that was used in Synthetic Example 1 was charged with 226.4 g (0.33 mol) of palm kernel oil and 97 g (1.09 mol) of 3-isopropyloxypropylamine. The mixture was raised to 95° C. while nitrogen is blown into the container and 5 g of 28% sodium methylate was added to the mixture. Thereafter, the resulting mixture was kept as it was for 3 hours. The termination of the reaction was confirmed by finding using gas chromatography that residual palm kernel oil was less than 3% and excess amine was distilled under reduced pressure.

Synthetic Example 9 (Synthesis of Lauric Acid Amidopropyl Isopropyl Ether)

The same reaction container that was used in Synthetic Example 1 was charged with 214 g (1 mol) of methyl laurate and 129 g (1.10 mol) of 3-isopropyloxypropylamine. The mixture was raised to 95° C. while nitrogen is blown into the container and 5 g of 28% sodium methylate was added. Thereafter, the mixture was kept as it was for 3 hours. The termination of the reaction was confirmed by finding using gas chromatography that residual methyl laurate was less than 3% and excess amine was distilled under reduced pressure.

Synthetic Example 10 (Synthesis of Coconut Oil Fatty Acid Amidopropyl Propyl Ether)

The same reaction container that was used in Synthetic Example 1 was charged with 217 g (0.33 mol) of coconut oil and 127.5 g (Mw: 117.1, 1.09 mol) of 3-propyloxypropylamine. The mixture was raised to 95° C. while nitrogen is blown into the container and 5 g of 28% sodium methylate was added. Thereafter, the mixture was kept as it was for 3 hours. The termination of the reaction was confirmed by finding using gas chromatography that residual coconut oil was less than 3% and excess amine was distilled under reduced pressure.

It is to be noted that in Synthetic Examples 2 to 10, each compound was confirmed to be a target compound from the measurements of the saponification value and total amine value and from the infrared absorption spectrum in the same manner as in Synthetic Example 1.

Example 1

The viscosity of an aqueous solution obtained by formulating each of the fatty acid amide ether compounds obtained in Synthetic Examples 1 to 10 or a thickener selected from the comparative compounds at the concentration shown in Table 1 in a sodium polyoxyethylene (average EO addition mol number=2) lauryl ether sulfate was determined under the following condition. Also, the melting point of each thickener was measured according to a capillary heating method. Results are shown in Table 1.

<Viscosity Measuring Condition>

Total concentration of the thickener and the surfactant: 20% by weight

Measuring pH: 7.0

Measuring temperature: 25° C.

Viscometer: B-type viscometer

TABLE 1

| Thickener | Viscosity (mPa · s) Compounded amount* (weight-%) 0 | 1 | 3 | 5 | Melting point (° C.) |
|---|---|---|---|---|---|
| Product of the invention | | | | | |
| Fatty acid amide ether compound of Synthetic Example 1 | 8 | 33 | 950 | 21000 | 52 |
| Fatty acid amide ether compound of Synthetic Example 2 | 8 | 25 | 250 | 6500 | 30 |
| Fatty acid amide ether compound of Synthetic Example 3 | 8 | 30 | 520 | 11000 | 33 |
| Fatty acid amide ether compound of Synthetic Example 4 | 8 | 45 | 1900 | 20000 | 47 |
| Fatty acid amide ether compound of Synthetic Example 5 | 8 | 31 | 290 | 18500 | 43 |
| Fatty acid amide ether compound of Synthetic Example 6 | 8 | 31 | 1100 | 7800 | 21 |
| Fatty acid amide ether compound of Synthetic Example 7 | 8 | 27 | 1050 | 11500 | 43 |
| Fatty acid amide ether compound of Synthetic Example 8 | 8 | 30 | 1250 | 18500 | 21 |
| Fatty acid amide ether compound of Synthetic Example 9 | 8 | 31 | 750 | 12000 | 41 |
| Fatty acid amide ether compound of Synthetic Example 10 | 8 | 28 | 470 | 5500 | 29 |
| Comparative product | | | | | |
| lauric acid diethanolamide | 8 | 20 | 156 | 3600 | — |
| Coconut fatty acid monoethanolamide | 8 | 35 | 1500 | 13000 | 70 |
| Lauric acid monoethanolamide | 8 | 38 | 1800 | Clouded | 90 |

*Concentration of each thickener in the aqueous solution.

Example 2 (Evaluation of Surface Activity)

0.5 g of rape seed oil and 0.1 g of each of the fatty acid amide ether compounds obtained in Synthetic Examples 1 to 10 were placed in a flask charged with 50 g of ion exchange water and stirred by a hand mixer for one minute. Then, the mixture was allowed to stand for 10 minutes and the emulsified state of the rape seed oil was observed visually to evaluate according to the following standard.

<Standard of Evaluation> x: Separated

○: Clouded and Dispersed

TABLE 2

| | State of emulsification |
|---|---|
| Fatty acid amide ether compound of synthetic example 1 | ○ |
| Fatty acid amide ether compound of synthetic example 2 | ○ |
| Fatty acid amide ester compound of synthetic example 3 | ○ |
| Fatty acid amide ether compound of synthetic example 4 | ○ |
| Fatty acid amide ether compound of synthetic example 5 | ○ |
| Fatty acid amide ether compound of synthetic example 6 | ○ |
| Fatty acid amide ether compound of synthetic example 7 | ○ |
| Fatty acid amide ether compound of synthetic example 8 | ○ |
| Fatty acid amide ether compound of synthetic example 9 | ○ |

TABLE 2-continued

| | State of emulsification |
|---|---|
| Fatty acid amide ether compound of synthetic example 10 | ○ |

It is confirmed from Table 2 that all the compounds obtained in Synthetic Examples had surface activity.

What is claimed is:

1. A thickener comprising a fatty acid amide ether compound represented by the formula (1):

(1)

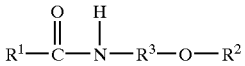

wherein $R^1$ represents a straight-chain or branched alkyl or alkenyl group which has 5 to 21 carbon atoms and may be substituted with at least one hydroxyl group, $R^2$ represents a straight-chain or branched alkyl group having 1 to 12 carbon atoms and $R^3$ represents an alkylene group having 2 to 12 carbon atoms.

2. A thickener comprising a fatty acid amide ether compound represented by the formula (1—1):

(1-1)

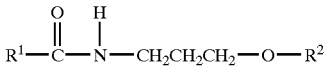

wherein $R^1$ represents a straight-chain or branched alkyl or alkenyl group which has 5 to 21 carbon atoms and may be substituted with at least one hydroxyl group, $R^2$ represents a straight-chain or branched alkyl group having 1 to 12 carbon atoms.

3. A thickener comprising a fatty acid amide ether compound represented by the formula (1–2):

(1-2)

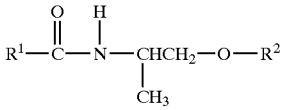

wherein $R^1$ represents a straight-chain or branched alkyl or alkenyl group which has 5 to 21 carbon atoms and may be substituted with at least one hydroxyl group, $R^2$ represents a straight-chain or branched alkyl group having 1 to 12 carbon atoms.

4. A surfactant composition comprising the thickener as claimed in claim 1 and at least one surfactant.

5. The surfactant composition according to claim 4, wherein the surfactant is an anionic surfactant.

6. A method of using the fatty acid amide ether compound represented by the formula (1) as a thickener comprising:

mixing the fatty acid amide ether compound with a liquid (1)

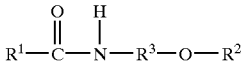

wherein $R^1$ represents a straight-chain or branched alkyl or alkenyl group which has 5 to 21 carbon atoms and may be substituted with at least one hydroxyl group, $R^2$ represents a straight-chain or branched alkyl group having 1 to 12 carbon atoms and $R^3$ represents an alkylene group having 2 to 12 carbon atoms.

7. A method of thickening a surfactant comprising mixing the fatty acid amide ether compound represented by the formula (1) with the surfactant:

(1)

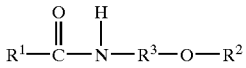

wherein $R^1$ represents a straight-chain or branched alkyl or alkenyl group which has 5 to 21 carbon atoms and may be substituted with at least one hydroxyl group, $R^2$ represents a straight-chain or branched alkyl group having 1 to 12 carbon atoms and $R^3$ represents an alkylene group having 2 to 12 carbon atoms.

8. A surfactant composition comprising the thickener as claimed in claim 2 and at least one surfactant.

9. A surfactant composition comprising the thickener as claimed in claim 3 and at least one surfactant.

10. The surfactant composition according to claim 8, wherein the surfactant is an anionic surfactant.

11. The surfactant composition according to claim 9, wherein the surfactant is an anionic surfactant.

12. A fatty acid amide ether compound represented by the formula (1):

(1)

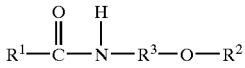

wherein $R^1$ represents a straight-chain or branched alkyl or alkenyl group which has 5 to 21 carbon atoms and may be substituted with at least one hydroxyl group, $R^2$ represents a straight-chain or branched alkyl group having 1 to 12 carbon atoms and $R^3$ represents an alkylene group having 2 to 12 carbon atoms.

13. A fatty acid amide ether compound represented by the formula (1— 1):

(1-1)

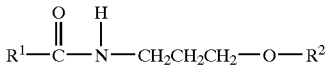

wherein $R^1$ represents a straight-chain or branched alkyl or alkenyl group which has 5 to 21 carbon atoms and may be substituted with at least one hydroxyl group, $R^2$ represents a straight-chain or branched alkyl group having 1 to 12 carbon atoms.

14. A fatty acid amide ether compound represented by the formula (1–2):

(1-2)

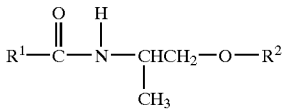

wherein $R^1$ represents a straight-chain or branched alkyl or alkenyl group which has 5 to 21 carbon atoms and may be substituted with at least one hydroxyl group, $R^2$ represents a straight-chain or branched alkyl group having 1 to 12 carbon atoms.

* * * * *